US011628989B2

(12) United States Patent
Sanchez

(10) Patent No.: US 11,628,989 B2
(45) Date of Patent: Apr. 18, 2023

(54) CHILD-RESISTANT CONTAINER AND CLOSURE

(71) Applicant: Mike C Sanchez, Dallas, TX (US)

(72) Inventor: Mike C Sanchez, Dallas, TX (US)

( * ) Notice: Subject to any disclaimer, the term of this patent is extended or adjusted under 35 U.S.C. 154(b) by 0 days.

(21) Appl. No.: 17/476,396

(22) Filed: Sep. 15, 2021

(65) Prior Publication Data

US 2022/0002043 A1 Jan. 6, 2022

Related U.S. Application Data

(60) Provisional application No. 63/163,037, filed on Mar. 18, 2021.

(51) Int. Cl.

| | |
|---|---|
| ***B65D 50/06*** | (2006.01) |
| ***B65D 1/02*** | (2006.01) |
| ***B65D 41/04*** | (2006.01) |
| ***B65D 41/06*** | (2006.01) |

(52) U.S. Cl.

CPC ..... *B65D 50/061* (2013.01); *B65D 1/0246* (2013.01); *B65D 41/0471* (2013.01); *B65D 41/06* (2013.01); *B65D 2251/04* (2013.01)

(58) Field of Classification Search

CPC ..... B65D 50/061; B65D 2215/04; B65D 1/0246; B65D 50/06; B65D 41/0471; B65D 41/06

USPC ..... 215/317, 321

See application file for complete search history.

(56) References Cited

U.S. PATENT DOCUMENTS 942,141 A * 12/1909 Hoffman ..... B65D 41/06 215/332
1,499,612 A * 7/1924 Hammer ..... B65D 41/0471 215/44
1,849,523 A * 3/1932 Hammer ..... B65D 41/0471 215/262
1,977,589 A * 10/1934 Merolle ..... B65D 41/06 215/330
2,003,784 A * 6/1935 Hammer ..... B65D 41/0471 220/301
3,465,908 A * 9/1969 Acton ..... B65D 41/0442 215/333
4,373,641 A * 2/1983 Banich, Sr. ..... B65D 41/04 215/331
5,147,053 A * 9/1992 Friedenthal ..... B65D 50/046 215/221
5,552,117 A * 9/1996 Burns ..... B01L 3/50825 215/354
5,829,609 A * 11/1998 Beck ..... B65D 50/048 215/217

(Continued)

*Primary Examiner* — John K Fristoe, Jr.
*Assistant Examiner* — Jennifer Castriotta
(74) *Attorney, Agent, or Firm* — Barry Choobin; Patent 360

(57) ABSTRACT

A child-resistant container and closure, the container has a cylindrical neck, and an outer surface of the neck has three lug threads that consecutively run along the circumference of the neck. A pointer pointing upwards is present just below the neck. The closure has a central section and a skirt, the skirt has three male threads, wherein the three male threads can engage with the three lug threads. The outer surface of the skirt has a downward pointing pointer, wherein two pointers must be aligned for engaging and disengaging the three male threads and the three lug threads.

11 Claims, 3 Drawing Sheets

(56) References Cited

U.S. PATENT DOCUMENTS

| | | | | |
|---|---|---|---|---|
| 10,399,728 | B2 * | 9/2019 | Brozell | B65D 1/0246 |
| 2014/0263339 | A1 * | 9/2014 | Bates | B65D 41/0464<br>220/296 |

* cited by examiner

CHILD-RESISTANT CONTAINER AND CLOSURE

CROSS-REFERENCE TO RELATED APPLICATIONS

This application claims priority to the U.S. provisional patent application Ser. No. 63/163,037, filed on Mar. 18, 2021, which is incorporated herein by reference in its entirety.

FIELD OF INVENTION

The present invention relates generally to a child-resistant combination of container and closure, and more particularly, the present invention relates to a reusable combination of container and closure that is difficult to be opened by a child.

BACKGROUND

Child-resistant packaging or CR packaging is known in the art as a special packaging that is difficult for a child to open but can be easily opened by adults. Child-resistant packaging is mandatory for certain substances, particularly hazardous substances, to reduce the risk of children ingesting hazardous substances. People do not want containers to be easily opened by children or unauthorized individuals when the containers carry a substance that is harmful, controlled, dangerous, or costly. Notably, prescription medicines and household chemicals are at particular risk of being accessed by children. Some substances are subject to legal restrictions, such as most notably, mind-altering substances, like marijuana and derivatives. Another type of consumable that is restricted is pharmaceuticals and marijuana-based or hemp-based products. Casual consumption can be dangerous if consumed to excess or without proper administration. Several governments institute laws and regulations mandate child-protective barriers be used to prevent minors from accessing controlled substances, such as cannabis and cannabis products.

The European Union and the United States maintain regulations as to child-resistant packaging for drugs and other substances. The United States Consumer Product Safety Commission (CPSC) regulated child-resistant packaging based on the Poison Prevention Packaging Act (PPPA). The special packaging requirements under the PPPA are directed towards designing packaging to make it significantly difficult for children under five years old to open the packaging or obtain a toxic or harmful amount of the substance therein within a reasonable amount of time. The requirements also maintain that it should not be difficult for ordinary adults to use the packaging properly. Thus, caps and closures for containers should usually be tight enough to maintain a seal and resist working loose. Still, such containers should not be so difficult to open that the intended end user cannot conveniently open the container.

Therefore, a desire is there for child-resistant packaging that is economical to manufacture and can be opened readily and easily by adults.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a child-resistant combined container and closure that is difficult to be opened by a child.

It is another object of the present invention that the disclosed combined container and closure can be easily opened by an adult.

It is still another object of the present invention that the disclosed combined container and closure are economical to manufacture.

It is yet another object of the present invention that the disclosed combined container and closure are reusable.

It is a further object of the present invention that the disclosed combined container and closure are simpler in construction but effective as child-resistant packaging.

In one aspect, the container includes a base and an upstanding wall defining an inner volume of the container. The container has an open top for gaining access into the inner volume of the container. A cylindrical neck extends upwards from a periphery of the open top of the container. An outer surface of the neck has at least three lug threads that consecutively run along the circumference of the neck. A first lower pointer can be provided just below the neck, wherein the first lower pointer points upwards. The closure has a central section and a skirt that perpendicularly extends downwards from a periphery of the central section. The skirt has an inner surface and an outer surface. The inner surface of the skirt has at least three male threads such as the at least three male threads of the closure can engage with the at least three lug threads of the container for securing the closure to the container. The outer surface of the skirt has a first upper pointer which points downwards, wherein the first upper pointer and the first lower pointer are positioned such that the at least three male threads and the at least three lug threads can engage and disengage only when the first upper pointer is aligned to the first lower pointer.

In one aspect, the first upper pointer and the first lower pointer can be triangular.

In one aspect, the container can have a second lower pointer and a third lower pointer, and the closure can have a second upper pointer and a third upper pointer, wherein the alignment of the first upper and lower pointers results in alignment of the second upper and lower pointers and the third upper and lower pointers. The first upper and lower pointers can be visually distinct from the second and third upper and lower pointers.

In one aspect, to close the closure, the pointers in the closure can be aligned to the corresponding pointers in the container, thereafter the closure can be slightly depressed over the container and then twisted, thereby preventing the separation of the closure from the container. To remove the closure, the closure can be twisted till the pointers in the closure can be aligned to the corresponding pointers in the container, and thereafter the closure can be pulled using slight force, thereby resulting in the separation of the closure from the container.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
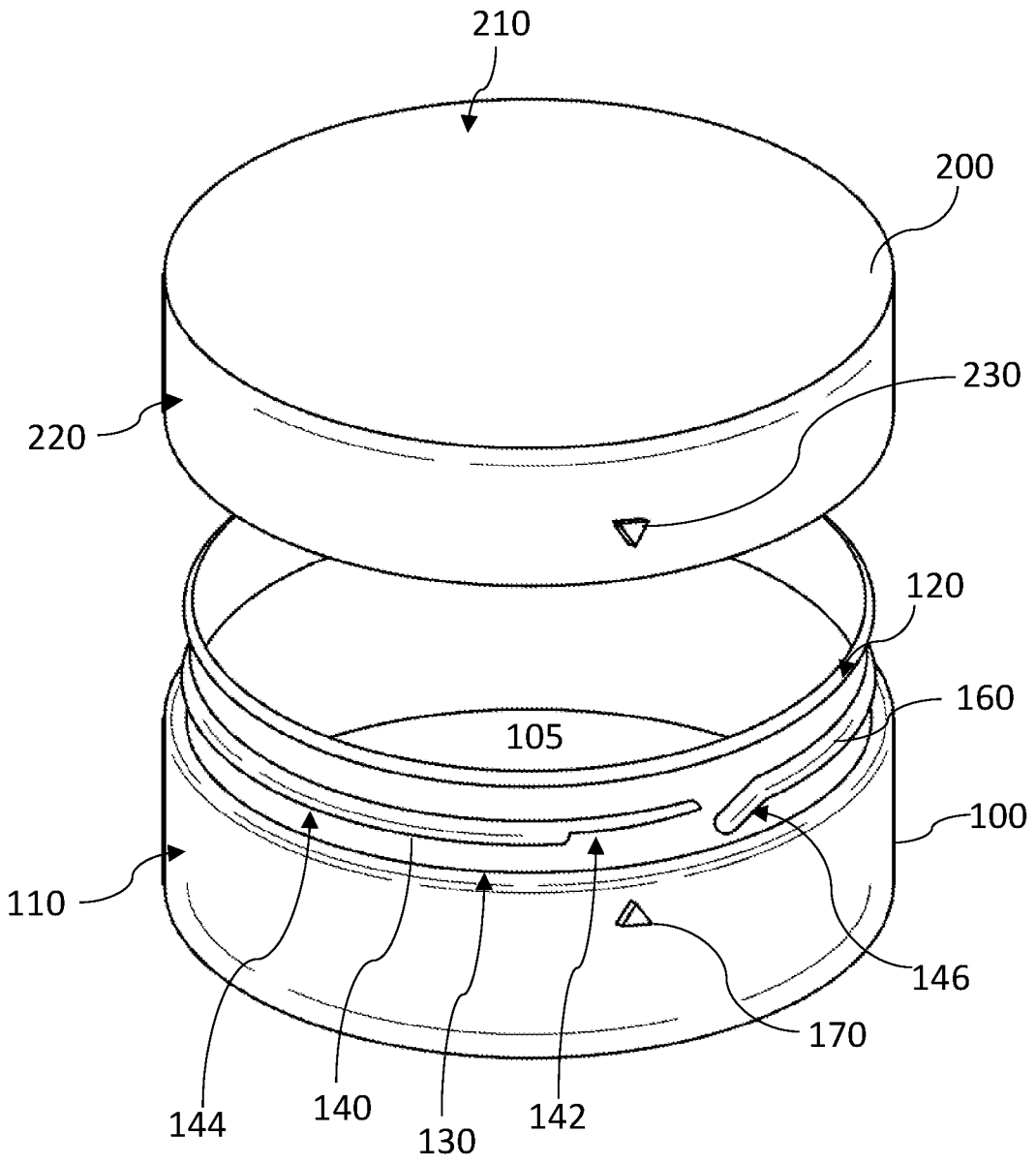
FIG. 1 is a perspective view of the container and the closure, according to an exemplary embodiment of the present invention.

Referring to FIG. 1 which shows an exemplary embodiment of container 100 and the closure 200. The container 100 can include a base 105 and a wall 110 that define an inner volume of the container 100. The container 100 can include an open-top for gaining access to the inner volume of the container 100. The container 100 shown in FIG. 1 is round however, containers of any other shape and size are within the scope of the present invention. The container 100 shown in FIG. 1 can be a palm-size container used for storing medicines or psychotropic substances. The container can be made from a medical-grade material, such as plastic or metal. Coatings of suitable material can also be provided for safety and aesthetic purposes, such as a colored coating can be provided. In one case, the container can be made from a lightweight metal such as tin or aluminum. A cylindrical neck 120 can extend upwards from a periphery 130 of the wall 110. The neck 120 can be seen offset from the wall 110, wherein the wall 110 can curve inwards to form a step and then extend upwards to form the neck 120. The outer surface of the neck 120 can include multiple lug threads that run consecutively along the circumference of the neck 120. It may be preferable for small size container to have three consecutive lug threads covering the entire circumference of the neck, however, two or more lug threads are within the scope of the present invention. For example, containers with a larger diameter may have four or more consecutive lug threads. Each lug thread 140 can have a proximal end 142, mid 144, and a distal end 146. The lug thread 140 can deflect slightly downwards from the proximal end towards near the distal end and the distal end can sharply taper downwards touching the periphery 130 of the open top. The distal end may act as a stop limiting the rotation of the closure while securing the closure to the container. In one case, the proximal end 142 portion of the lug thread 140 can be notched to have a lesser width than a width of the rest of the lug thread.

In one case, the width of the proximal end 142 portion of the lug thread 140 can be about 2 mm while the width of the rest of the lug thread can be about 2.5 mm. In one case, the proximal end portion of the lug thread can be about 3 mm from the periphery 130. The mid of the lug thread can be about 2.5 mm, and the near distal end can be about 2 mm from the periphery 130. The height of the neck 120 from the periphery 130 can be about 11 mm and height of the skirt 220 of the closure 200 can be about 14 mm. It is to be understood that the dimensions and arrangements of different parts of the disclosed container and the closure are for illustration purposes only, and a skilled person will appreciate that the dimensions and volume of different parts of the container and closure can be varied without departing from the scope of the present invention. For example, width of the lug thread 140 can be varied but the width of the proximal end 142 portion can be critical for engaging and disengaging of the closure to the container. The width of the proximal end 142 portion can be slightly shorter than the width of the rest of lug thread 140 but cannot be too narrow do defeat the purpose of the child-resistant packaging but allowing the closure to be easily removed from the container.

In one case, the container 100 can have an outer dimeter of about 68 mm and the closure 200 can have an outer diameter of about 68 mm. The height of the wall 110 of the container 100 can be about 20 mm. The inner diameter of the neck 120 of the container 100 can be about 53.5 mm. It is to be understood that the dimensions and volumes of the disclosed container and closure can vary without departing from the scope of the present invention.

Figure 3:
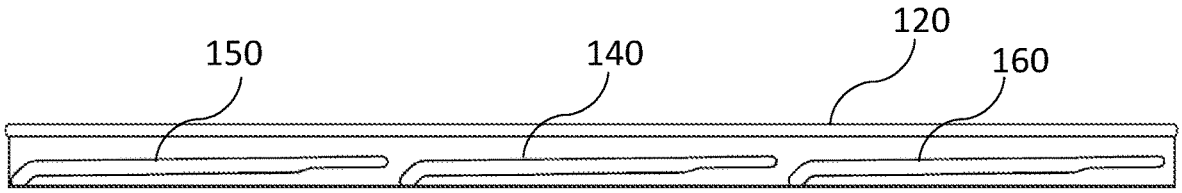
FIG. 3 illustrates the arrangement of three lug threads of the neck, according to an exemplary embodiment of the present invention.

A proximal end of the lug thread can be substantially above a distal end of an adjacent lug thread, such as a channel is formed between the proximal end of one lug thread and the distal end of the adjacent lug thread. The proximal ends of all the lug threads can be in the same plane while the distal ends can contact the periphery 130. Two other lug threads, a second lug thread 150 and a third lug thread 160, can be there adjacent to the proximal and distal ends of lug thread 140. FIG. 3 shows the three lug threads and their arrangement on the neck 120 of the container 100.

Also, can be seen in FIG. 1 is a pointer 170 that can be triangular and can point upwards towards the neck 120 of the container 100. The pointer can be of any other shape, such as an arrowhead, any such shape of the pointer is within the scope of the present invention. Additionally, more than one pointer can be provided spaced at equal distances from each other. The number of pointers can be proportional to the number of lug threads in the container. For example, FIG. 1 has three equally spaced pointers. The pointers may appear visually the same or can be distinguished, such as a change in color or texture.

Figure 2:
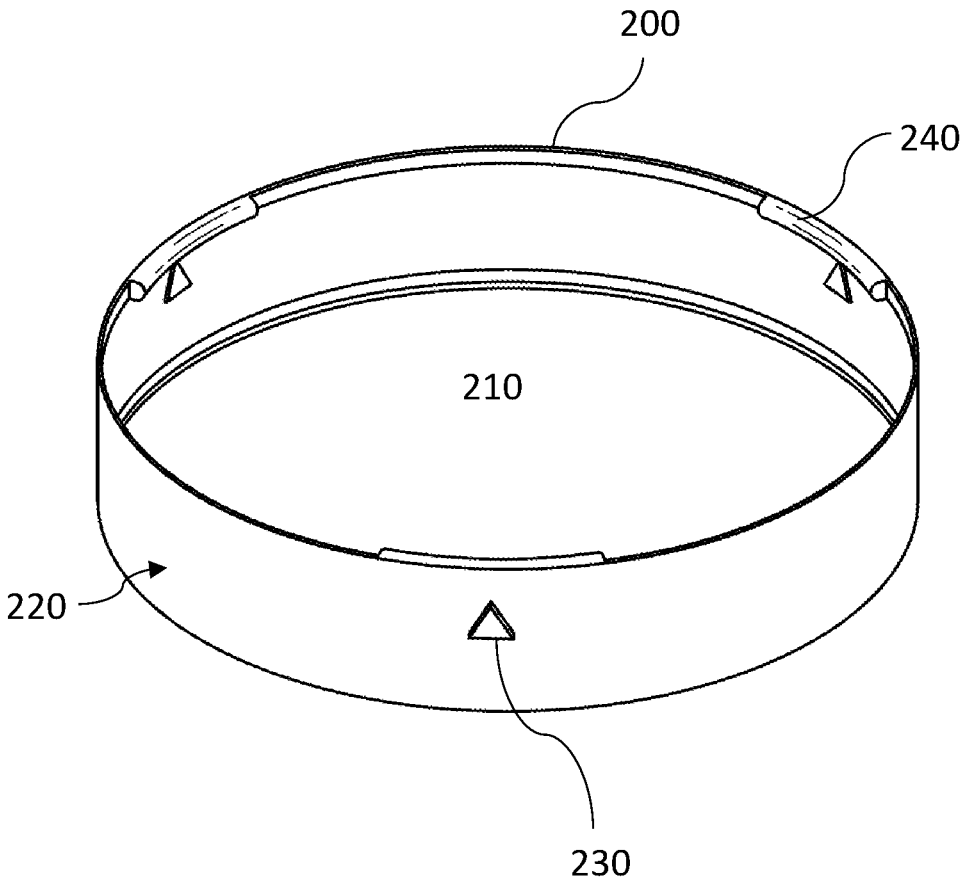
FIG. 2 is a bottom perspective view of the closure showing male threads, according to an exemplary embodiment of the present invention.

The closure 200 can be used to close the open top of the container 100. The closure 200 can have a central section 210 and a skirt 220 that extends downwards from a periphery of the central section 210. The skirt 220 can overlap the neck 120 of the container 100 when mounted over the container. The step formed between wall 110 and neck 120 of the container can receive the skirt 220, such as the outer surface of the skirt and the outer surface for the wall of the container can be smooth and continuous. The inner surface of the skirt 220 can have male threads that can slidably engage and disengage with the lug threads 140 in the neck 120 of the container for closing the closure to the container. FIG. 2 shows a bottom view of the closure 200 having three male threads 240. The male threads 240 can be seen provided along a rim of the skirt. In one case, the rolled rim of the closure can be stamped to create the male threads. Each male thread is positioned relative to the pointer on the outer surface of the closure. Also, each male thread can correspond to the notched proximal end portion of the lug thread. The male thread can pass over the notched proximal end portion of the lug thread under slight force.

The closure can be grasped and twisted to open and close the closure. Another pointer 230, referred to hereinafter as an upper pointer can also be provided on the outer surface of the skirt 220. For each lower pointer on the container, there can be a corresponding upper pointer on the closure. The lower pointer and the corresponding upper pointer can form a pair, wherein the pointers in a pair are positioned such as a male thread of the closure and a proximal end portion of the lug thread of the container can be engaged and disengaged when the upper pointer is aligned to the lower pointer. When the pointers are aligned, the male thread of the closure can be aligned to the notched proximal end portion of the lug thread.

To close the closure, the closure can be aligned relative to the open top of the container such as the upper pointer and the lower pointer are along a common axis. When the pointers can be aligned, the closure can be placed over the neck of the container. Now the closure can be slightly depressed and twisted, wherein the male threads of the closure can slidably engage with the corresponding lug threads of the container, thereby preventing the separation of the closure. To remove the closure from the container, the closure can again be twisted till the two pointers of a pair are aligned and thereafter, the closure can be pulled by little force, thereby resulting in the separation of the closure from the container.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A childproof combination of container and closure comprising:

a container comprising:

a base and a wall defining an inner volume of the container, the container has an open-top, a neck extends from a periphery of the wall, an outer surface of the neck has at least three lug threads that run consecutively along a circumference of the neck, and at least one lower pointer on the wall of the container just below the periphery of the wall, wherein the at least one lower pointer points upwards; and a closure comprising:

a central section and a skirt that extends downwards from a periphery of the central section, the skirt has an inner surface and an outer surface, the inner surface of the skirt has at least three male threads, and at least one upper pointer on the outer surface of the skirt, wherein the at least one upper pointer points downwards, wherein the at least one upper pointer and the at least one lower pointer are positioned such that the at least three male threads engage and disengage with the at least three lug threads only when the at least one upper pointer is aligned to the at least one lower pointer, wherein each lug thread of the at least three lug threads has a proximal end, a mid, and a distal end, wherein each lug thread slightly deflects downwards from the proximal end towards near the distal end, and wherein the distal end sharply tapers downwards contacting the periphery of the wall, a proximal end portion of each lug thread is notched, wherein each male thread of the at least three male threads is directly above or below the respective proximal end portion of the lug thread when the at least one upper pointer is aligned with the at least one lower pointer, wherein each male thread of the at least three male threads is configured to snap over the respective proximal end portion of the lug thread when a vertical force is applied on the closure.

2. The childproof combination of container and closure according to claim 1, wherein a number of the at least one lower pointer or a number of the at least one upper pointer is equal to a number of the at least three lug threads.

3. The childproof combination of container and closure according to claim 1, wherein the at least three lug threads comprise three lug threads, the at least one lower pointer comprises three lower pointers, the at least three male threads comprise three male threads, and the at least one upper pointer comprises three upper pointers.

4. The childproof combination of container and closure according to claim 1, wherein the proximal end of each lug thread is substantially directly above a distal end of an adjacent lug thread of the at least three lug threads, forming a channel between the proximal end of each lug thread and the distal end of the adjacent lug thread.

5. The childproof combination of container and closure according to claim 1, wherein a width of the proximal end portion of each lug thread is less than a width of the remaining portions of each lug thread.

6. The childproof combination of container and closure according to claim 1, wherein the at least three male threads are disposed along a rim of the skirt.

7. The childproof combination of container and closure according to claim 1, wherein each male thread of the at least three male threads is directly above the respective proximal end portion of the lug thread when engaging the at least three male threads with the at least three lug threads, and wherein each male thread of the at least three male threads is directly below the respective proximal end portion of the lug thread when disengaging the at least three male threads from the at least three lug threads.

8. A method for restricting access to a container by a child, the method comprising the steps of:

providing a childproof combination of container and closure, the container comprising:

a base and a wall defining an inner volume of the container, the container has an open-top, a neck extends from a periphery of the wall, an outer surface of the neck has at least three lug threads that run consecutively along a circumference of the neck, at least one lower pointer on the wall of the container just below the periphery of the wall, wherein the at least one lower pointer points upwards, and a closure comprising:

a central section and a skirt that perpendicularly extends downwards from a periphery of the central section, the skirt has an inner surface and an outer surface, the inner surface of the skirt has at least three male threads, at least one upper pointer on the outer surface of the skirt, wherein the at least one upper pointer points downwards, wherein the at least one upper pointer and the at least one lower pointer are positioned such that the at least three male threads engage and disengage with the at least three lug threads only when the at least one upper pointer is aligned to the at least one lower pointer, wherein each male thread of the at least three male threads is directly above or below the respective proximal end portion of the lug thread when the at least one upper pointer is aligned with the at least one lower pointer;

positioning the closure above the container such that the at least one upper pointer is aligned to the at least one lower pointer;

depressing the closure over the neck of the container with a slight force; and upon depressing, twisting the closure.

9. The method according to claim 8, wherein the method further comprises the steps of:

upon twisting the closure, twisting again the closure relative to the container until the at least one upper pointer is aligned to the at least one lower pointer; and upon twisting again, pulling the closure upwards with a slight force to separate the closure from the container.

10. The method according to claim 8, wherein the step of depressing the closure over the neck of the container with the slight force causes each male thread of the at least three male threads to snap-over the respective proximal end portion of the lug thread.

11. A childproof combination of container and closure comprising:

a container comprising:

a base and a wall defining an inner volume of the container, the container has an open-top, a neck extends from a periphery of the wall, an outer surface of the neck has a plurality of lug threads that run consecutively along a circumference of the neck, and at least one lower pointer on the wall of the container just below the periphery of the wall, wherein the at least one lower pointer points upwards; and a closure comprising:

a central section and a skirt that extends downwards from a periphery of the central section, the skirt has an inner surface and an outer surface, the inner surface of the skirt has a plurality of male threads, at least one upper pointer on the outer surface of the skirt, wherein the at least one upper pointer points downwards, wherein the at least one upper pointer and the at least one lower pointer are positioned such that the plurality of male threads engages and disengages with the plurality of lug threads only when the at least one upper pointer is aligned to the at least one lower pointer, wherein each lug thread of the plurality of lug threads has a proximal end and a distal end, wherein each lug thread slightly deflects downwards from the proximal end towards near the distal end, and wherein the distal end sharply tapers downwards contacting the periphery of the wall, a proximal end portion of each lug thread is notched, wherein each male thread of the plurality of male threads is directly above or below the respective proximal end portion of the lug thread when the at least one upper pointer is aligned with the at least one lower pointer, wherein each male thread of the plurality of male threads is directly above the respective proximal end portion of the lug thread when engaging the plurality of male threads with the plurality of lug threads, and wherein each male thread of the plurality of male threads is directly below the respective proximal end portion of the lug thread when disengaging the plurality of male threads from the plurality of lug threads.

* * * * *